US005183708A

United States Patent [19]

Yoshida et al.

[11] Patent Number: 5,183,708

[45] Date of Patent: Feb. 2, 1993

[54] CUSHION STRUCTURE AND PROCESS FOR PRODUCING THE SAME

[75] Inventors: Makoto Yoshida, Ibaraki; Hironori Yamada, Matsuyama; Nobuo Takahashi, Ikoma; Kazushi Fujimoto, Matsumoto, all of Japan

[73] Assignee: Teijin Limited, Osaka, Japan

[21] Appl. No.: 809,524

[22] PCT Filed: May 27, 1991

[86] PCT No.: PCT/JP91/00703

§ 371 Date: Jan. 23, 1992

§ 102(e) Date: Jan. 23, 1992

[87] PCT Pub. No.: WO91/19032

PCT Pub. Date: Dec. 12, 1991

[30] Foreign Application Priority Data

May 28, 1990 [JP] Japan ..... 2-135346

[51] Int. Cl.[5] ..... D02G 3/00

[52] U.S. Cl. ..... 428/373; 428/198; 428/288; 428/296; 156/62.6; 156/62.8; 156/308.2

[58] Field of Search ..... 156/62.6, 62.8, 308.2; 428/198, 288, 296, 373

[56] References Cited

U.S. PATENT DOCUMENTS

| | | | |
|---|---|---|---|
| 2,755,215 | 7/1956 | Talalay | 156/62.6 |
| 3,368,934 | 2/1968 | Vosburgh, Sr. | 156/62.6 |
| 4,068,036 | 1/1978 | Stanistreet | 428/369 |
| 4,281,042 | 7/1981 | Pamm | 428/288 |
| 4,306,929 | 12/1981 | Menikheim et al. | 156/62.6 |
| 4,418,116 | 11/1983 | Scott | 428/296 |
| 4,520,066 | 5/1985 | Athey | 428/296 |
| 4,551,378 | 11/1985 | Carey, Jr. | 156/62.6 |
| 4,695,334 | 9/1987 | Mays | 156/62.2 |
| 4,783,364 | 11/1988 | Ilan | 428/287 |
| 4,818,599 | 4/1989 | Marcus | 428/288 |
| 4,957,804 | 11/1990 | Hendrix et al. | 428/288 |
| 5,021,286 | 6/1991 | Minegishi et al. | 428/288 |

*Primary Examiner*—Marion E. McCamish
*Assistant Examiner*—N. Edwards
*Attorney, Agent, or Firm*—Sherman and Shalloway

[57] ABSTRACT

A cushion structure whose resilience to compression, compression durability and recovery from compression are improved and which is free from bottom-hit feel, in the matrix of which an elastomeric conjugated fiber containing as one of the components a thermoplastic elastomer is dispersed and mixed and wherein amebic, all-directionally flexible heat-bonded spots formed at the crossing points of the conjugated fibers and semi-all-directionally flexible heat-bonded spots formed at the crossing points of the conjugated fibers with the non-elastomeric, crimped polyester staple fibers are scatteringly present and, in conjugated fibers present between any two adjacent, flexible heat-bonded spots, part of them contain at least one thick portion in the longitudinal direction.

30 Claims, 6 Drawing Sheets

100μm

100μm

50μm

CUSHION STRUCTURE AND PROCESS FOR PRODUCING THE SAME

TECHINCAL FIELD

This invention relates to a novel cushion structure which comprises non-elastomeric, crimped polyester staple fibers serving as the matrix in which heat-bonded spots with elastomeric conjugated fibers are scattered, and also to a process for producing the same.

TECHNICAL BACKGROUND

In the art of cushion structures which are used in household furniture, beds and the like, foamed polyurethane mat, non-elastomeric, crimped polyester staple fiberfill, resin bonded fiber mat or thermally bonded fiber mat formed by adhering crimped polyester staple fibers, etc. have been used.

However, foamed polyurethane mat has problems that the chemicals used in the process of its production are difficult to handle and that freon is discharged. Furthermore, because the compression characteristics of foamed polyurethane mat show a unique feature that it is hard at the initial stage of compression and then abruptly sinks down, it not only is scanty in cushioning property but also gives a strong "bottom-hit feel". Still more, the mat has little air-permeability and consequently is apt to become stuffy, which renders the mat objectionable as a cushion structure in many cases. On top of it, foamed polyurethane mat is soft and has little resilient power to compression because it is foamed. The resilient power can be improved by increasing density of the foamed mat, but such also increases the weight and invites a fatal defect that its air-permeability is still aggravated. Further, non-elastomeric polyester staple fiberfill has defects that it is apt to be deformed during the use because the aggregate structure is not fixed, and its bulkiness or resilient power is considerably reduced as the constituent staple fibers migrate or the crimps therein fade away.

On the other hand, resin bonded fiber mat and thermally bonded fiber mat wherein non-elastomeric, crimped polyester staple aggregates are bound with a resin (e.g., polyacrylate) or binder fibers made of a polymer having a melting point lower than that of the polymer constituting the matrix staple fibers (Japanese Laid-Open Patent Application No. 31150/1983) show weak bonding strength. Also because the polymer film has a low elongation and little recovery from extension, the bonded points show low durability. Hence, such fiber mat products are apt to be broken when the bonded points are deformed during the use, or show poor recovery after deformation and consequently, their shape retention or resilient power drop drastically. Still more, since the bonded points are formed of a polymer of low elongation, they are rigid and lack mobility, resulting in poor cushioning performance. As means to improve the cushioning performance, Japanese Laid-Open Patent Application No. 102712/1087 proposes a cushion structure wherein the crossing points of crimped polyester staple fibers are fixed with a foamed polyurethane binder. The product, however, is apt to cause unevenness in processing because a solution type, crosslinkable polyurethane is impregnated. Consequently the treating solution is cumbersome to handle; adherability between polyurethane and polyester fibers is low; and because the binder is crosslinked, the product shows reduced elongation. Furthermore, because the resin portion is foamed, deformation tends to occur concentratively at localized spots. This leads to problems that it is easily broken when the foamed polyurethane at the fiber-crossing portions is heavily deformed; and that its durability is low.

DISCLOSURE OF THE INVENTION

The present invention relates to provide a novel cushion structure in which particularly the staple fiber-to-staple fiber adhesion at their crossing points is markedly stabilized, whereby the cushioning property, resilient power to compression, compression durability and recovery from compression are improved.

The invention furthermore relates to provide above cushion structure through a more simplified process in which occurrence of unevenness in processing is prevented.

According to the present invention, there is provided a novel cushion structure comprising, as the matrix, a non-elastomeric, crimped polyester staple fiber aggregate and having a density of 0.005 to 0.10 g/cm$^3$ and a thickness of at least 5 mm, wherein said staple fiber aggregate contains, as dispersed and mixed therein, and elastomeric conjugated fiber (conjugated staple fiber) which is composed of a thermoplastic elastomer having a melting point lower than that of the polyester polymer constituting the staple fiber, by at least 40° C., and a non-elastomeric polyester, the former being exposed at least at the fiber surface, and in said cushion structure (A) amebic, all-directionally flexible heat-bonded spots formed by mutual heat fusion of said elastomeric conjugated fibers at their crossing points, and (B) semi-all-directionally flexible heat-bonded spots formed by heat fusion of said elastomeric conjugated fibers with said non-elastomeric polyester staple fibers at their crossing points, are present scatteringly, and in the elastomeric conjugated fibers present between any two adjacent, flexible heat-bonded spots [between (A) and (A), between (A) and (B) or between (B) and (B)], some of them have at least one thick portion in the longitudinal direction.

According to the present invention there is also provided a process for production of above novel cushion structure, which comprises mixing a non-elastomeric, crimped polyester staple fiber with an elastomeric conjugated fiber which is composed of a thermoplastic elastomer having a melting point lower than that of the polyester polymer constituting said non-elastomeric, crimped polyester staple fiber, by at least 40° C., and a non-elastomeric polyester, the former occupying at least a half of the elastomeric conjugated fiber surface, to form a web having a bulkiness of at least 30 cm$^3$/g thereby to form three-dimensional fiber crossing points among the elastomeric conjugated fibers or between the non-elastomeric, crimped polyester staple fibers and the elastomeric conjugated fibers; and thereafter heat-treating the web at a temperature lower than the melting point of the polyester polymer but higher than the melting point of the elastomer by 10° to 80° C., to cause heat-fusion of at least part of the fiber crossing points.

THE OPTIMUM EMBODIMENT FOR PRACTICING THE INVENTION

The invention is hereafter explained more specifically in further details.

Figure 1:
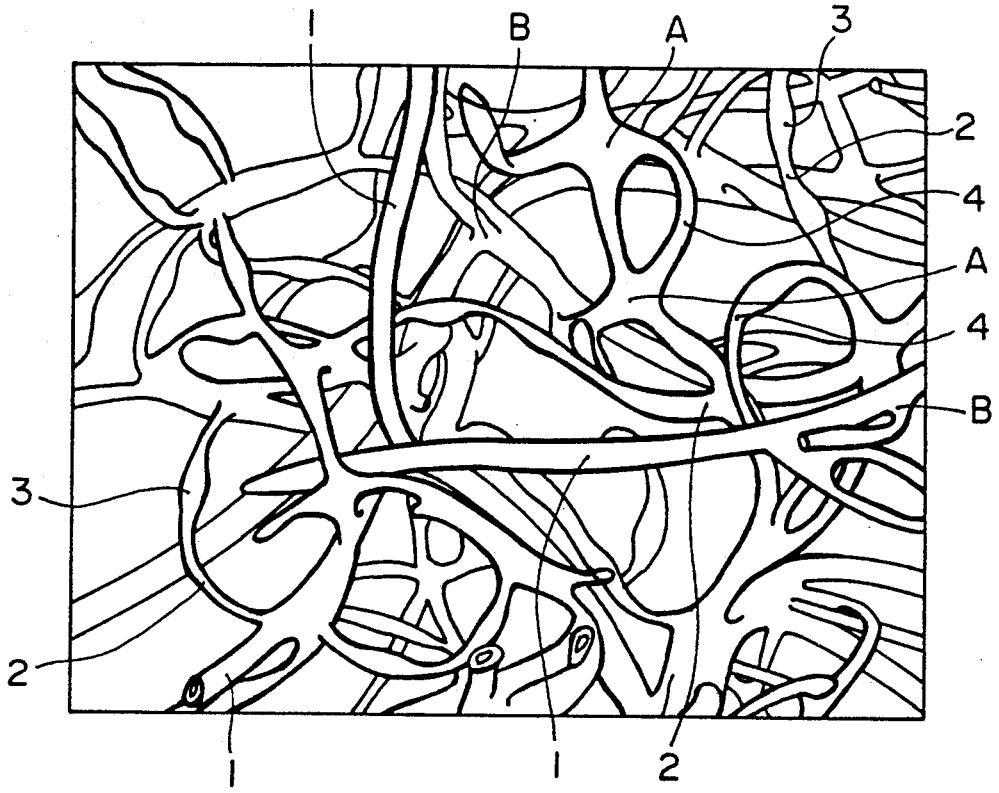
FIGS. 1(*a*) and (*b*) show cross-sectional views of a cushion structure of the present invention which are copied from the electron micrographs (magnification: 70X) of FIGS. 4(*a*) and (*b*), respectively.
Figure 1:
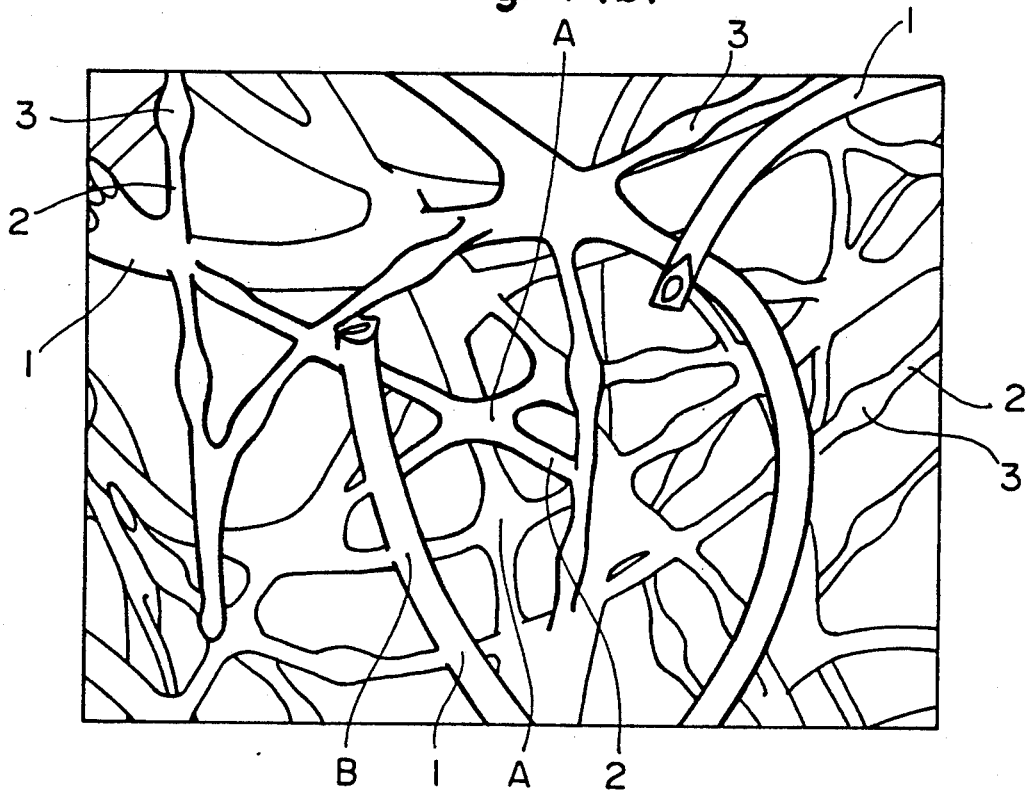

In FIGS. 1(*a*) and (*b*), 1 is the non-elastomeric, crimped polyester staple fibers, serving as the matrix of the cushion structure; 2 is the elastomeric conjugated fibers composed of a thermoplastic elastomer having a melting point lower than that of the polyester polymer constituting said staple fibers, by at least 40° C., and a non-elastomeric polyester, the former being exposed at least at the fiber surfaces, and said elastomeric fibers being dispersed and mixed in the matrix. The characteristics of the cushion structure, as indicated by these drawings, are that in the cushion structure, (1) amebic, all-directionally flexible heat-bonded spots formed by mutual heat-fusion of the thermoplastic elastomer at the crossing points of the elastomeric conjugated fibers 1, as indicated by (A), and (2) semi-all-directionally flexible heat-bonded spots formed by heat-fusion of the elastomer component at the crossing points of the elastomeric conjugated fibers 2 with the non-elastomeric polyester staple fibers 1, as indicated by (B)

are scatteringly present (viz., there exists no bonded spot between the matrix staple fibers) and (3) in each of the elastomeric conjugated fiber groups, which is present between any two adjacent, flexible heat-bonded spots [between (A) and (A), between (A) and (B) or between (B) and (B)], part of the conjugated fibers have at least one thick portion 3 in the longitudinal direction.

Figure 2A:
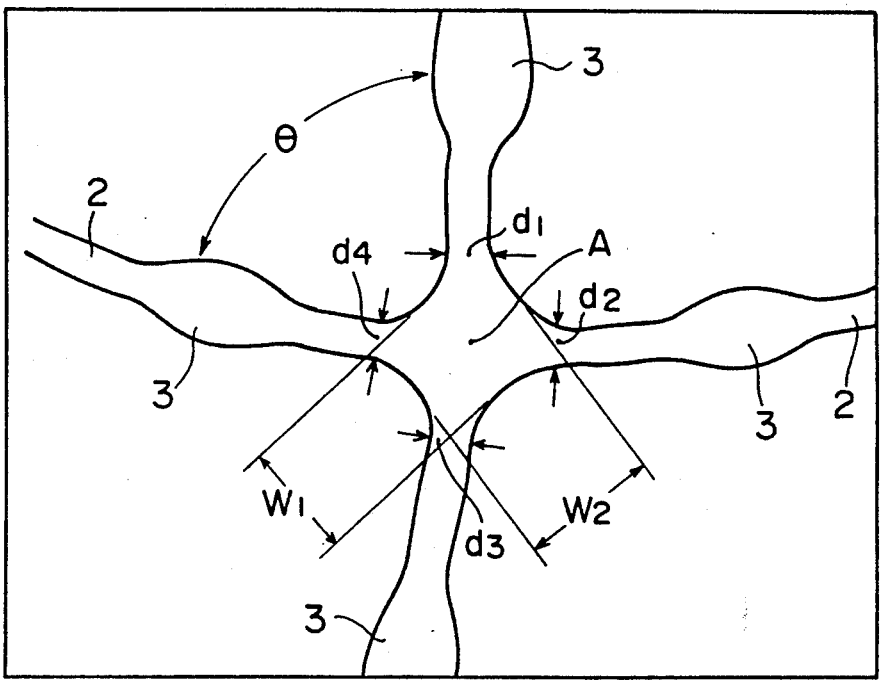
FIGS. 2(*a*), (*b*) and (*c*) are front views of the amebic, all-directionally flexible heat-bonded spots and semi-all directionally flexible heat-bonded spots, which are scatteringly present in the cushion structure of the present invention as unique bonding points, said views being taken from the electron micrographs (magnification; 350X) of FIGS. 5(*a*), (*b*) and (*c*), respectively.
Figure 2B:
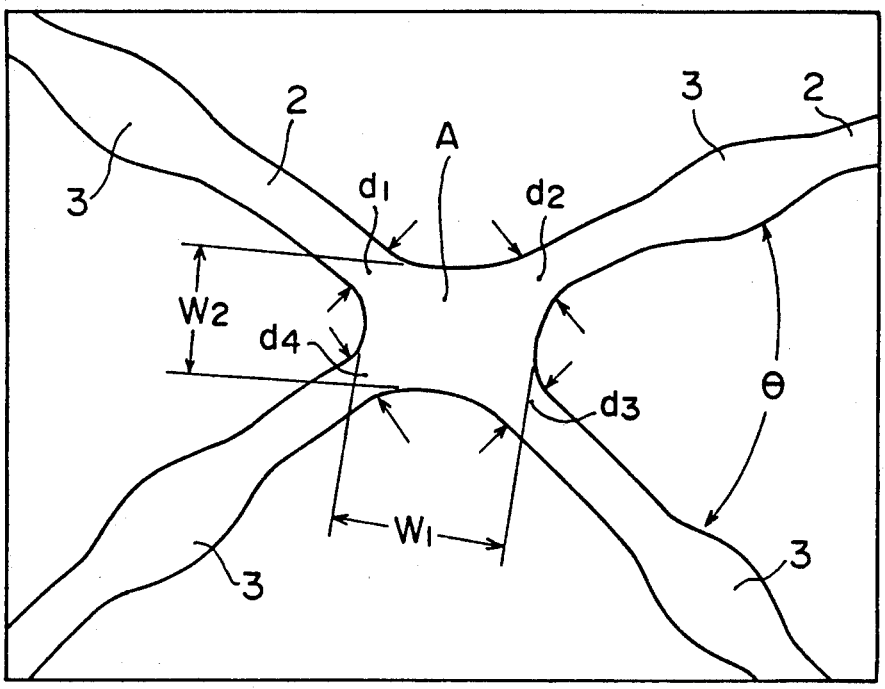
Figure 2C:
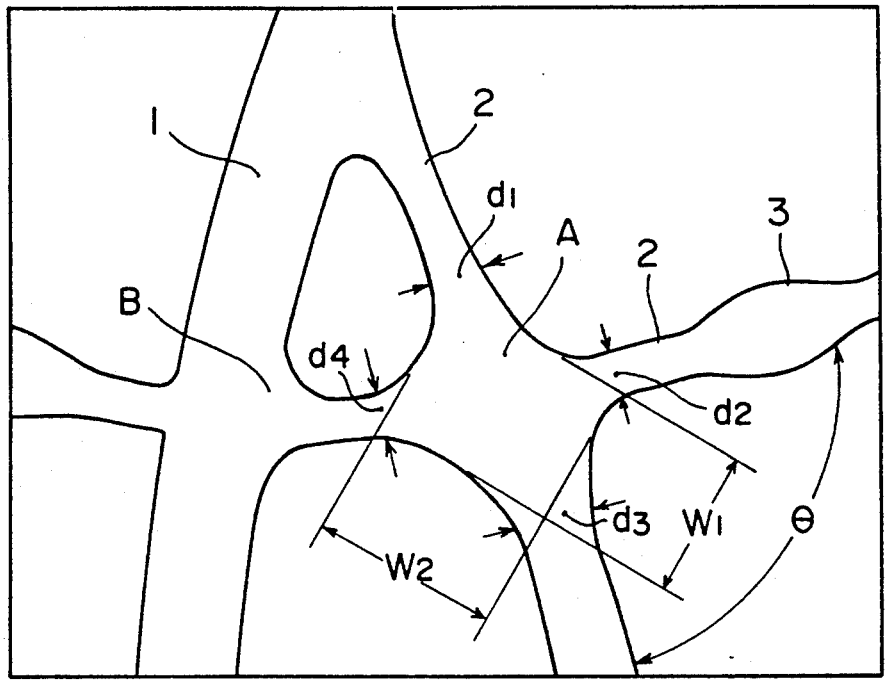

Here the "all-directionally flexible heat-bonded spot" specifies a heat-bonded spot which has the flexibility such that, when a load is exerted on the cushion structure and consequently also on the bonded spot, it is freely deformable in the direction of the load and is recoverable to its original state when the load is removed. The heat-bonded spots can be divided into two classes; the one including those indicated by (A) above, which are amebic and formed by heat fusion of the thermoplastic elastomers at the crossing points of the elastomeric conjugated fibers themselves; and the other, those indicated by (B), which are the heat-bonded spots where the thermoplastic elastomer component in the elastomeric conjugated fiber 2 and the non-elastomeric, crimped polyester staple fiber 1 cross each other at an intercrossing angle $\theta$ which ranges from 45° to 90°, as indicated in FIGS. 2(*a*), (*b*) and (*c*).

It has been found that the elastomeric conjugated fibers 2, which are dispersed and mixed in the matrix, cross with each other or with the non-elastomeric, crimped polyester staple fibers 1 at random, and when they are subjected to a heat-fusion treatment in this state, thick portions 3 are intermittently formed in the longitudinal direction of said elastomeric conjugated fibers 2. These portions 3 are formed as the thermoplastic elastomer, which is one component of the elastomeric conjugated fiber 2, migrates in the direction of the fiber axis, affected by factors such as its melt viscosity and surface tension. At the time the above-described flexible heat-bonded spots (A) and (B) are formed, the thermoplastic elastomer in fluidized state migrates to, and aggregates at, the fiber-crossing points to form the amebic or semi-amebic bonded spots. That is, because the heat-bonded spots formed by heat-fusion of the elastomeric conjugated fibers as in (A) are, after all, formed by mutual fusion of the thick portions, they come to have the amebic shape. On the other hand, where a heat-bonded spot (B) is formed, said thick portion 3 bonds with the non-elastomeric conjugated staple fiber 1 by itself. Consequently, in comparison with the amebic shape of (A), it can be deemed to have a semi-amebic shape. FIGS. 2(*a*), (*b*) and (*c*) are the front views taken from the electron micrographs (350X) of the amebic and semi-amebic heat-bonded spots.

The phenomenon that the thick portions 3 are formed by localized migration and aggregation of the thermoplastic elastomer signifies that the probability of formation of the flexible heat-bonded spots (A) and (B) in the cushion structure increases correspondingly to the occurrence of said phenomenon. Naturally, the portions 3 which do not participate in the fusion remain as they are. In consequence, in certain cases the linkages between any two heat-bonded spots, viz., (A)—(A), (A)—(B) or (B)—(B) are secured by the elastomeric conjugated fiber having some of the thick portions still remaining therein.

Density of the cushion structure itself, too, is a factor to be considered in the occasion of forming such flexible heat-bonded spots. When it is higher than 0.10 g/cm$^3$, the fiber density becomes excessively high and mutual fusion of the thermoplastic elastomer is apt to occur at an excessively high frequency. Consequently, the product comes to show a markedly reduced elasticity in the thickness direction, an extremely low air-permeability and a tendency to become stuffy, becoming no more serviceable as a cushion structure.

On the other hand, when the density is less than 0.005 g/cm$^3$, the structure exhibits low resilience, and number of the non-elastomeric, crimped polyester staple fibers constituting the matrix becomes less. Consequently, when a load is applied onto said structure, strain or stress exerted on individual fibers becomes excessive, rendering the structure itself readily deformable and scanty of durability. Thus, the product neither is suitable as a cushion structure. In connection with this aspect, Japanese Laid-Open Patent Applications Nos. 197312/83 and 85575/77 recommend that most of the elastomeric conjugated fibers be mutually fused in substantially parallel state as observed from the cross-sectional direction. In the present invention, however, such condition should not be allowed to occur.

When the cushion structure of the present invention is compared with conventional cushion structures, the following notable differences exist therebetween.

In conventional products, for example, the non-elastomeric, crimped staple fibers constituting a matrix are bound at their crossing points only, with a resin or a crosslinkable urethane solution which are not fibers. In contrast thereto, in the cushion structure of the present invention, no bonding spot is formed at any crossing point of the matrix-forming crimped staple fibers, but only at the crossing points of the elastomeric conjugated fibers and at those of the elastomeric conjugated fibers with the matrix-forming crimped staple fibers, the bondings are formed by heat fusion of the thermoplastic elastomer contained in the elastomeric conjugated fiber. Furthermore, in a cushion structure where a conjugated fiber containing, as the fusible component, a non-elastomeric polymer having a low melting temperature is used as a binder, the heat-bonded spots are close to point-to-point adhesion, never taking an amebic shape as in the present invention. Still more, such bonding points are non-flexible, and the binder fibers intermediating those bonding points themselves do not have the thick portions. Such points also exhibit poor recovery from deformation, while the bonded spots according to the present invention exhibit all-directional flexibility, and are connected by the elastomeric conjugated fibers rich in recovery from deformation.

From the foregoing description, it can be understood that the cushion structure of the present invention exhibits excellent resilience to compression and recovery from compression, because the all-directionally flexible heat-bonded spots (A) and (B) are present therein, and also because those heat-bonded spots are linked by an elastomeric conjugated fiber, making up a three-dimensionally elastomeric structure.

Hereunder the characteristic features of the all-directionally flexible heat-bonded spots (A) according to the present invention are described.

Each of said spots is formed by migration and aggregation of the thermoplastic elastomer contained in the conjugated fiber and, therefore, broadly covers the crossing points among fibers, and has a smooth surface. Also the outer circumference of the spot covering the fiber-crossing point presents a curved surface such as hyperbola. Accordingly:

(i) it is free of concentration of stress;
(ii) because of the markedly improved strength and elongation properties, it does not break under repetitive compression;
(iii) it is resistant to deformation under compression (viz., shows strong resilience to deformation);
(iv) once deformed, it is easily deformable in any directions (viz., all-directionally);
(v) further, it is smoothly recoverable from deformation in any directions; and
(vi) because two adjacent heat-bonded spots are connected by the elastomeric conjugated fiber, they are ready to restore their original positions after displacement.

It can be readily understood that the semi-all-directionally flexible heat-bonded spots (B) also exhibit the same tendency as above, although in somewhat less extent.

Next, the requirements which are incidental to the cushion structure of the present invention are described.

First, the amebic, all-directionally flexible heat-bonded spot preferably has a W/D ratio within a range of 2.0 to 4.0, where W is the width of the heat-bonded spot and is the mean value of $W_1$ and $W_2$, as indicated in FIG. 2; D is the mean diameter of the elastomeric conjugated fibers participating in the heat-bonding, calculated from the diameters ($d_1$, $d_2$, $d_3$ and $d_4$) of the parts adjacent to the root of the heat-bonded spot, as indicated in FIG. 2. The elastomeric conjugated fiber interposed among these heat-bonded spots frequently has the thick portions 3 at an interval of at least $10^{-2}$ cm. Furthermore, said elastomeric conjugated fiber interposed among heat-bonded spots sometimes takes a curved form 4 like a loop or in certain cases develops coiled, elastic crimps, as shown in FIG. 1 as (A) and (B).

The all-directionally or semi-all-directionally flexible heat-bonded spots (hereafter they may be collectively referred to simply as "heat-bonded spots") in the present invention function to reduce the stress and strain which are applied onto the crimped staple fibers constituting the matrix, by freely deforming responsive to those forces when the cushion structure is loaded (compressed) and thereby dispersing the stress and strain. Therefore, physical properties of those heat-bonded spots are by no means negligible. As the pertinent physical properties, breaking strength, elongation-at-break, and elastic recovery percentage of 10% elongation can be given, which properties being defined later. As the breaking strength, the preferred range is between 0.3 g/de and 5.0 g/de. When it is less than 0.3 g/de, the heat-bonded spots are apt to break under a drastic compressive deformation occurring in the cushion structure (e.g., to 75% of the initial thickness). This is likely to lead to deterioration in durability and shape retention.

On the other hand, a fusion treatment at considerably high temperatures is required to make the strength of the heat-bonded spots higher than 5 g/de, which consequently deteriorates physical properties of the crimped staple fibers themselves that constitute the matrix.

The elongation-at-break is preferably within the range of 15 to 200%. When it is less than 15%, in case drastic deformation due to compression occurs in the cushion structure, not only the heat-bonded spots come to show still greater displacement and distortion, but also the intercrossing angles $\theta$ change beyond the deformation limit, and eventually the bonded spots become easier of destruction.

When the elongation exceeds 100%, the heat-bonded spots tend to cause distortion under such displacing force, and the durability may also be reduced accordingly.

Further, the elastic recovery percentage of 10% elongation preferably is at least 80%, particularly within the range of 80 to 95%. When it is less than 80%, recovery from deformation decreases in case stress or displacement is caused at the heat-bonded spots, which might invite degradation in durability under repetitive compression, or in dimensional stability.

The non-elastomeric, crimped polyester staple fibers constituting the matrix according to the invention include ordinary staple fibers formed of polyethylene terephthalate, polybutylene terephthalate, polyhexamethylene terephthalate, polytetramethylene terephthalate, poly-1,4-dimethylcyclohexane terephthalate, polypivalolactone, and their copolyesters; blends of such fibers; and conjugated fibers formed of at least two of above-mentioned polymer components. The single fibers may have any cross-sectional shapes such as circular, flattened, modified or hollow. The size of the single fiber preferably ranges from 2 to 500 deniers, particularly from 6 to 300 deniers. When the single fiber size is too small, density of the cushion structure increases to often impair elasticity of the structure as a whole, whereas, when the size is too large, handlability of the fibers, particularly web-forming property, is impaired. Further, the number of fibers forming the matrix becomes objectionably small, to reduce the number of the crossing points formed by them and the elastic conjugated fibers, which results in poor elasticity development in the cushion structure and concurrently in reduction of durability. Still in addition, the hand becomes objectionably rough.

The elastomeric, conjugated fibers that are used for forming the heat-bonded spots performing the important role in the present invention are composed of a thermoplastic elastomer and non-elastomeric polyester, preferably the former occupying at least ½ of the fiber surfaces. In terms of weight ratio, those in which the conjugation ratio of the former to the latter ranges from 30/70 to 70/30 are conveniently used. The structure of the elastomeric conjugated fibers may be either side-by-side or sheath-core form. The latter is the more preferred. In the case of sheath-core structure, naturally the non-elastomeric polyester serves as the core which may be concentrically or eccentrically located. Eccentric type is the more preferred, because it develops coil-formed elastic crimp.

As the thermoplastic elastomers, polyurethane elastomers and polyester elastomers are preferred.

Polyurethane elastomers are those obtained through reaction of a low-melting polyol having a molecular weight in the order of 500 to 6,000, e.g., dihydroxypolyether, dihydroxypolyester, dihydroxypolycarbonate, dihydroxypolyesteramide or the like; with an organic diisocyanate having a molecular weight not higher than 500, e.g., p,p'-diphenylmethane diisocyanate, tolylene diisocyanate, isophorone diisocyanate, hydrogenated diphenylmethane diisocyanate, xylylene diisocyanate, 2,6-diisocyanate methylcaproate, hexamethylene diisocyanate, etc.; and with a chain-extending agent having a molecular weight not higher than 500, e.g., glycol, aminoalcohol or triol. Of such polymers, particularly preferred are the polyurethanes, for the preparation of which polytetramethylene glycol, poly-e-caprolactone or polybutylene adipate is used as the polyol component. In this case, preferred organic diisocyanate component is p,p'-diphenylmethane diisocyanate, and the preferred chain-extending agent is p,p'-bishydroxyethoxybenzene or 1,4-butanediol.

Those useful as the polyester elastomers are the polyether/ester block copolymers formed through copolymerization of thermoplastic polyesters as the hard segments and poly(alkylene oxide) glycols as the soft segments. More specifically, the copolymers are ternary copolymers composed of at least one dicarboxylic acid selected from the group consisting of aromatic dicarboxylic acids such as terephthalic acid, isophthalic acid, phthalic acid, naphthalene-2,6-dicarboxylic acid, naphthalene-2,7-dicarboxylic acid, diphenyl-4,4'-dicarboxylic acid, diphenoxyethane dicarboxylic acid, sodium-3-sulfoisophthalate, etc., alicyclic dicarboxylic acids such as 1,4-cyclohexane dicarboxylic acid, aliphatic dicarboxylic acids such as succinic acid, oxalic acid, adipic acid, sebacic acid, dodecane-diacid, dimeric acid, etc.; and their ester-forming derivatives; at least one diol component selected from the group consisting of aliphatic diols such as 1,4-butanediol, ethylene glycol, trimethylene glycol, tetramethylene glycol, pentamethylene glycol, hexamethylene glycol. neopentyl glycol, decamethylene glycol, etc., alicyclic diols such as 1,1-cyclohexanedimethanol, 1,4-cyclohexanedimethanol, tricyclodecanedimethanol, etc., and their ester-forming derivatives; and at least one poly(alkylene oxide) glycol having an average molecular weight of about 400–5,000, selected from the group consisting of polyethylene glycol, poly(1,2- and 1,3-propylene oxide)-glycol, poly(tetramethylene oxide)glycol or ethylene oxide/propylene oxide copolymers, and ethylene oxide/tetrahydrofuran copolymers.

From a view to consideration of the adhesiveness to non-elastomeric, crimped polyester staple fibers, temperature characteristics and strength, however, block copolymerized polyether-polyesters are preferred, in which polybutylene terephthalate serves as the hard segment and polyoxybutylene glycol, as the soft segment. In this case, the polyester portion constituting the hard segment is composed of polybutylene terephthalate whose main acid component is terephthalic acid and main diol component is butylene glycol component. Naturally, part (normally not more than 30 mole %) of the acid component may be substituted with other dicarboxylic acid component or oxycarboxylic acid component. Similarly, a part (normally not more than 30 mole %) of the glycol component may be substituted with dioxy component other than the butylene glycol component.

The polyether portion constituting the soft segment can be composed of the polyethers substituted with a dioxy component other than butylene glycol. The polymers may further contain various stabilizers, ultraviolet absorber, branching agent for increasing viscosity, delusterant, coloring agent and other various improvers as necessitated in individual occasions.

The degree of polymerization of the polyester elastomers preferably lies within the range of, when expressed in terms of inherent viscosity, from 0.8 to 1.7, particularly from 0.9 to 1.5. When the inherent viscosity is extremely low, the heat-bonded spots formed with the non-elastomeric, crimped polyester staple fibers serving as the matrix become more susceptible to breakage. On the contrary, when the viscosity is too high, the thick portions are difficult to be formed at the time of heat fusion.

As one of the basic characteristics, the thermoplastic elastomer preferably has the elongation-at-break, which is defined later, of at least 500%, particularly at least 800%. When this elongation is too low, the bondage at the heat-bonded spots is apt to be broken as the cushion structure is compressed and the deformation affects the heat-bonded spots.

Further, the stress on the termoplastic elastomer under 300% elongation is preferably not more than 0.8 $kg/mm^2$, particularly not more than 0.6 $kg/mm^2$. When this stress is too great, it becomes difficult for the heat-bonded spots to disperse the forces exerted on the cushion structure. Consequently, when the cushion structure is compressed, the force may break the bondage at the spots or, even if the breakage is avoided, distortion of the matrix-forming, non-elastomeric, crimped polyester staple fibers may result or the crimps may be faded away.

The recovery from 300% elongation of the thermoplastic elastomer is preferably at least 60%, particularly at least 70%. When this recovery from elongation is low, it may become difficult for the cushion structure to restore its original shape when it is compressed and the heat-bonded spots are deformed.

The thermoplastic elastomers should have a melting point lower than that of the polymers constituting the non-elastomeric, crimped polyester staple fibers, and do not cause the crimps in the non-elastomeric staple fibers to thermally fade out during the fusion treatment for forming the heat-bonded spots. In view of the above requirements, the melting point is preferably lower than that of the staple fiber-forming polymers by at least 40° C., particularly at least 60° C. The melting point of the thermoplastic elastomers can be, for example, within the range of 130° to 220° C.

When this temperature difference in the melting points is less than 40° C., the heating temperature employed for the fusion treatment, which is described later, becomes too high, causing the crimps in the non-elastomeric polyester staple fibers to fade away and deteriorating dynamic properties of said staple fibers. When the melting point of a particular thermoplastic elastomer cannot be determined with precision, its softening point may be substituted for the melting point.

As the non-elastomeric polyester to be used as the other component with above thermoplastic elastomer, those polyester polymers already described as being useful for the matrix-forming crimped staple fibers can be used. Of those polymers, polybutylene terephthalate is particularly preferred.

The conjugated fibers are dispersed and mixed in the matrix, in an amount of 10 to 70%, preferably 20 to 60%, based on the weight of the cushion structure. When this blend ratio is too low, number of heat-bonded spots is reduced and the resultant structure shows an increased tendency to be deformed and to have less elasticity, resilience and durability.

On the contrary, when the blend ratio is too high, number of the non-elastomeric, crimped polyester staple fibers to impart resilience to the structure becomes small, and resilient power of the structure as the whole becomes insufficient.

Furthermore, since a cushion structure is a material to resile against compression in the thickness direction, it should have a thickness of at least 5 mm, preferably at least 10 mm, more preferably at least 20 mm, in order to exhbit the intended performance. While the thickness normally ranges from about 5 to 30 mm, in certain cases it may be as thick as about 1–2 m.

In the production of the cushion structure of the present invention, a non-elastomeric, crimped polyester staple fiber is mixed with an elastomeric conjugated fiber which is composed of a thermoplastic elastomer having a melting point lower than that of the staple fiber by at least 40° C. and a non-elastomeric polyester, the former occupying at least a half of the conjugated fiber surfaces, to form a web having a bulkiness of at least 30 $cm^3/g$, forming three-dimensional fiber crossing points among the elastomeric conjugated fibers; and also between the conjugated fibers and the non-elastomeric, crimped polyester staple fibers; and thereafter the web is heat-treated at a temperature higher than the melting point of the elastomer by 10° to 80° C. to cause heat-fusion of at least a part of the crossing spots of the fibers.

More specifically, a mass (or web) of non-elastomeric, crimped polyester staple fibers, which has a bulkiness of 50 $cm^3/g$, preferably 80 $cm^3/g$, and a mass of elastomeric conjugated fibers which are preferably crimped, are passed through a carding machine to form a web in which the two kinds of the fibers are uniformly mixed. Such a mixing forms, within the web, numerous fiber-crossing points between the elastomeric conjugated fibers themselves and also between the conjugated fibers and the non-elastomeric, crimped polyester staple fibers. Then such webs are placed in a mold to a prescribed density and subjected to a fusion treatment at a temperature which is lower than the melting point of the polyester polymer but higher than the melting point (or flow-initiating point) of the thermoplastic elastomer in the elastomeric conjugated fibers by 10° to 80° C. Thereby the elastomer component is fused at the above fiber crossing points, to form those amebic, all-directionally flexible heat-bonded spots (A) and semi-all-directionally flexible heat-bonded spots (B) which are already described.

Here a "three-dimensional fiber crossing point" signifies a crossing point literally present at an angle less than 90° to the planes parallel to the thickness direction of the web. Naturally, many fiber-crossing points are formed simultaneously also on the planes parallel to the horizontal planes in this web. These, however, are observed rather characteristically in aggregates, resembling artificial leather (e.g., non-woven fabric) having a far higher density compared to cushion structures. Thus, the characteristic feature of the process of the present invention resides in that the three-dimensional fiber crossing points are formed in addition to the two-dimensional fiber crossing points, by rendering the web density at least 30 $cm^3/g$. When the cushion structure of a density not higher than 0.1 $g/cm^3$ is formed after the heat-fusion treatment, still the majority of the three-dimensional fiber crossing points are maintained.

The non-elastomeric, crimped polyester staple fibers and elastomeric conjugated fibers can be obtained through known spinning methods. The kind of the polymers, single fiber size, blend ratio of the two kinds of fibers, etc. for that occasion have already been described. It is preferred, furthermore, that both kinds of the fibers be drawn by at least 1.5X after spinning. Cushion structures made of drawn fibers exhibit higher resilient power and less tendency to fade away compared to those made of undrawn fibers. The reason therefor is presumably that, in the process of being drawn, converted to staple fibers and relaxed, non-crystalline portions are relieved and randomly rearranged to provide a fiber structure of still improved elasticity, said structure being maintained even after the fusion and solidification. Furthermore, the elastomeric conjugated fibers having lower heat-shrinkage are preferred. When the heat shrinkage is high, the fibers shrink notably in the occasion of heat-fusion before the thermoplastic elastomer therein is melted, and the conversion of fiber crossing points to heat-bonded spots occurs with less frequency. In order to reduce the heat shrinkage of the elastomeric conjugated fibers, it is recommended that the fibers be heat-treated after the drawing, at temperatures of 40° to 120° C. for at least 20 seconds.

Satisfactory crimps can be imparted to the staple fibers by stuff crimping. Preferred crimp count is 5–15-/in. (measured in accordance with JIS L1045), more preferably 8–12/in. And, it is also useful to impart anisotropy to the fiber structure at the spinning time by such means as anisotropic cooling, viz., to impart latent crimpability to the fibers, and thereafter to subject the fibers to stuff crimping.

EXAMPLES

The present invention is hereinafter further explained by reference to working examples.

In the examples, measurements of various properties are conducted as follows.

Measurement of breaking strength and elongation-at-break of heat-bonded spots:

In a cushion structure, the parts whereat each two different fibers crossed with each other at an intercrossing angle of 45° to 90° and the crossing point was bonded were sampled inclusive of the two fibers. Then the two different fibers bonded to each other at the bonded spot located approximately at the center were secured on the grips of a tensile tester at an interval of the sample length of 2 mm, and pulled at a speed of 2 mm/min. The elongation under the initial load of 0.3 g was read as the relaxation. The sample was further pulled until the bonded spot was broken, and the maximum tension exerted up to that time and the elongation at break were measured, and breaking strength and elongation at break of heat-bonded spots were calculated from the following equations. This test was given to randomly sampled ten bonded spots (A) and ten bonded spots (B), viz., sample number n=20, and breaking strength was indicated by the mean value of the test results [number of (A): number of (B)=1:1].

$$\text{Breaking strength (g/de)} = \frac{\text{tension at the breaking time (g)}}{\text{average denier of two staple fibers in the sample}}$$

$$\text{Elongation at break (\%)} = \frac{E_2 - E_1}{L + E_1} \times 100$$

$E_1$: relaxation (mm)
$E_2$: elongation (mm) at the maximum stress
L: distance (mm) between grips

Measurement of elastic recovery percentage of 10% elongation of heat-bonded spots:

The sampling and sample-mounting were conducted in identical manner with the measurement of breaking strength and elongation at break of the heat-bonded spots. The sample length under the initial load of 0.3 g was marked $L_o$, and the sample was pulled at a speed of 2 mm/min. After pulling the sample until the elongation reached 10% to the sample length, the load was removed immediately at the same speed. After removal of the load, the sample was left in that condition for 2 minutes, and pulled again at the same speed. The elastic recovery percentage of 10% elongation was determined from the difference l (mm) between the sample length under the initial load of 0.3 g and that after the second pulling under 0.3 g load, according to the equation below. Number of the testing and sampling were same as those for the above measurement of breaking strength.

$$\text{Elastic recovery percentage of 10\% elongation} = \left(1 - \frac{l}{l_o}\right) \times 100$$

$l_o$: length under 10% elongation (mm) $=L_o \times 0.1$
l: residual elongation (mm) (sample length when initial tension of 0.3 g was applied—sample length when second tension of 0.3 g was applied)

Measurement of thickness and density of the cushion structure

The metsuke (g/m$^2$) of a cushion structure adjusted to a flat sheet form was measured, and its thickness (cm) under a load of 0.5 g/cm$^2$ was also measured to allow the calculation of density (g/cm$^3$).

Measurement of inherent viscosity of polyester elastomers

Inherent viscosity of each polyester elastomer was measured at 35° C. in a phenoltetrachloroethane (equal weight) mixture solution.

Measurement of bulkiness of web

Staple fibers were formed into webs, which were superposed to make the metsuke 1,000 g/m$^2$. A sample cut out from so superposed webs was subjected to a load of 10 g/cm$^2$ for one minute and released. One minute thereafter the sample was measured for the thickness under a load of 0.5 g/cm$^2$, to allow the calculation of bulkiness (cm$^3$/g).

Measurement of physical properties of thermoplastic polymer (1) Preparation of sample film:

A polymer was fused in a nitrogen atmosphere at 300° C., defoamed, rolled at 100° C. by passing through a clearance set at 0.5 mm between a pair of metal rollers at a rate of 20 m/min. to provide a film of about 0.5 mm in thickness. From the film a 5 mm-wide and 50 mm-long sample was die-cut in the longitudinal direction, which was used as the film for measuring physical properties of the thermoplastic polymer.

(2) Measurement of elongation-at-break:

The above film was used at the sample length of 50 mm, and subjected to a tensile test at a pulling speed of 50 mm/min. to determine the elongation-at-break.

(3) Measurement of stress under 300% elongation:

The length of the sample film was set to be 50 mm, and the film was pulled and extended by 300% at a pulling rate of 50 mm/min. The stress measured in that occasion was divided by the initial cross-sectional area (thickness×width) of the sample, and the quotient is indicated as the value of stress (kg/mm$^2$) under 300% elongation.

(4) Measurement of recovery percentage of 300% elongation:

The sample film was set to be 50 mm long. The film was pulled downwardly and extended by 300% at a pulling rate of 50 mm/min. and then relaxed by freely removing the stress exerted on the sample at a rate of 50 mm/min. The sample film was left in that state for 2 minutes and then again pulled at a rate of 50 mm/min. The relaxation length (mm) of the sample was determined from the length of the sample under a stress of 2 g before the sample was initially pulled down and that of the sample under the same load but after the 2 minutes' standing, and its ratio (%) to the extended length of 150 mm was calculated as (1-relaxation length/150)×100 (%), which is indicated as the recovery percentage of 300% elongation.

(5) Melting point:

Using a differential thermal analysis meter, Model 990 made by Du Pont Co., the melting peak temperature of each sample polymer was measured at the temperature rise rate of 20° C./min.

(6) Softening point:

Using a device for melting point of a trace sample (manufactured by Yanagimoto Seisakusho), about 3 g of a polymer was placed between two sheets of cover glass, and while softly pressing the system with a pincette, the temperature was raised at a rate of about 10° C./min., under which thermal change in the sample polymer was observed, and the temperature at which the polymer softened and started to flow was read as the softening point.

Measurement of compression resilience and compression durability of cushion structure A cushion structure which was adjusted to a flat sheet form and had a density of 0.035 g/cm$^3$ and a thickness of 5 cm, was compressed with a columnar rod having a flat bottom with a cross-sectional area of 20 cm$^2$, by 1 cm. The stress (initial stress) in that occasion was measured and indicated as the compression resilience. After the measurement, the structure was compressed under a load of 800 g/cm$^2$ for 10 seconds and then after removing the load, allowed to stand for 5 seconds. This cycle of compression-release procedures was repeated 360 times, and 24 hours thereafter the compression stress was measured again. The ratio (%) of the stress after the repetitive compression to the initial stress is recorded as the compression durability of the cushion structure.

Measurement of recovery from compression of cushion structure

Figure 3:
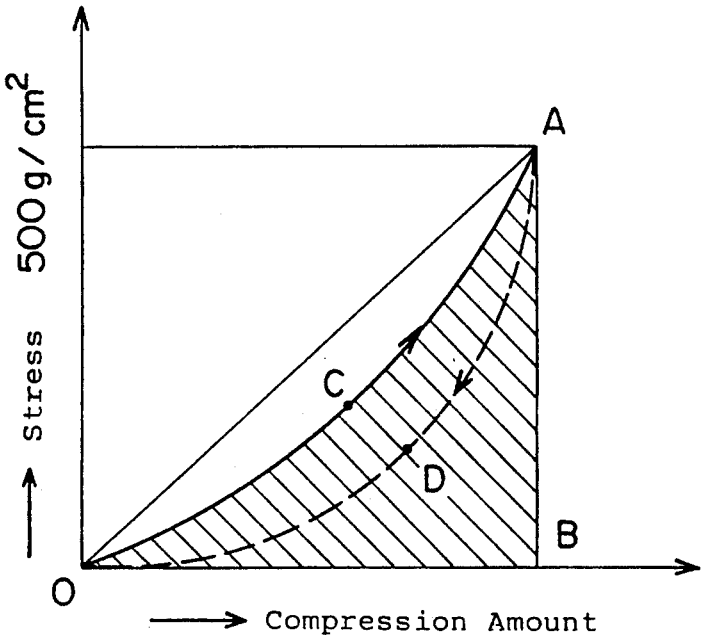
FIG. 3 is a graph used for calculating the recovery from compression of the cushion structure.

A cushion structure which was adjusted to a flat sheet form and had a density of 0.035 g/cm$^3$ and a thickness of 5 cm, was compressed with a columnar rod having a flat bottom with a cross-sectional area of 20 cm$^2$, at a rate of 100 mm/min. until the load reached 500 g/cm$^2$. Then immediately the load was removed at a rate of 100 mm/min., and from the area obtained from the compression length-stress curve (FIG. 3) plotted by the above measurement, the recovery from compression (Rc) of the structure was calculated.

$$\text{Recovery from compression } (RC)\ (\%) = \frac{\text{area enclosed by } ODAB}{\text{area enclosed by } OCAB} \times 100$$

EXAMPLE 1

An acid component, which was a 80/20 (mole %) mixture of terephthalic acid and isophthalic acid, was polymerized with butylene glycol, and 38% (by weight) of the resultant polybutylene terephthalate was further allowed to react with 62% (by weight) of polybutylene glycol (molecular weight: 2,000) under heating, to provide a block co-copolymerized polyether polyester elastomer. This thermoplastic elastomer had an inherent viscosity of 1.0, a melting point of 155° C., an elongation-at-break as the film of 1500%, a stress under 300% elongation of 0.3 kg/mm$^2$, and a recovery percentage of 300% elongation of 75%.

This thermoplastic elastomer was spun with polybutylene terephthalate in a customary manner to provide a sheath-core fiber at a core/sheath weight ratio of 50/50, the elastomer serving as the sheath and the other, as the core. The resultant conjugated fiber was an eccentric sheath-core type conjugated fiber. The fiber was drawn by 2.0X, cut by a length of 64 mm, heat-treated in warm water of 95° C. to undergo a low heat-shrinking and crimp-developing, dried, and subjected to an oiling treatment. The single fiber size of the above-obtained elastomeric conjugated fiber was 6 deniers.

This conjugated fiber (40% by weight) was mixed with 60% (by weight) of a hollow polyethylene terephthalate staple fiber, which was prepared in a customary manner, having a single fiber size of 14 deniers, fiber length of 64 mm, and a crimp number of 9/in. with a carding machine. (The web bulkiness of the staple fiber was 120 cm$^3$/g; melting point of the polyethylene terephthalate was 259° C.) Thus a web with bulkiness of 70 cm$^3$/g was obtained. A plurality of this web were piled up one on another, placed in a flat mold having a sheet shape to a thickness of 5 cm and a density of 0.035 g/cm$^3$, and heat-treated at 200° C. for 10 minutes, to provide a flat sheet-formed cushion structure. The thermoplastic elastomer occupied 20% (by weight) of the cushion structure.

Figure 4A:
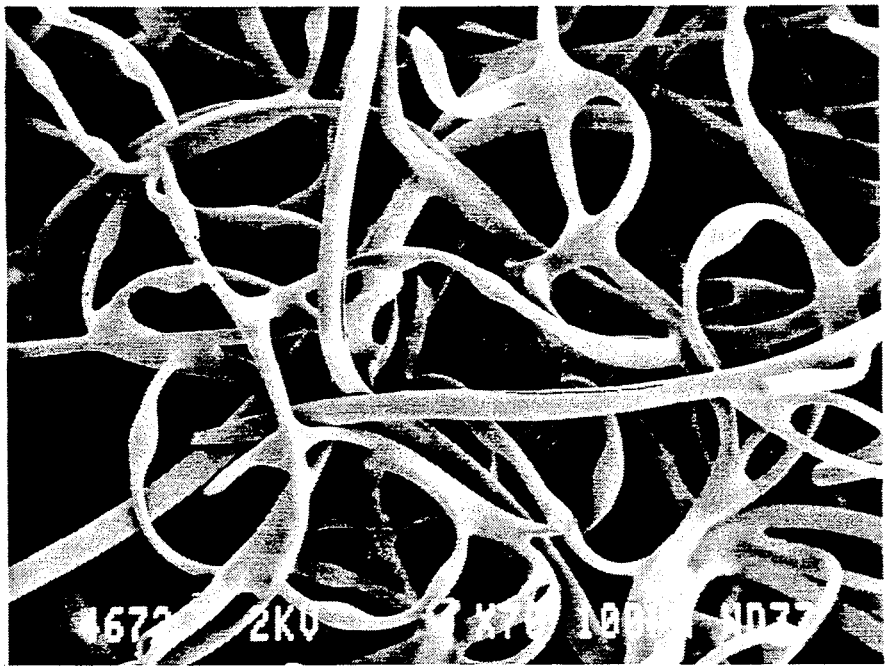
FIGS. 4(*a*) and (*b*) are electron micrographs showing the construction of the cushion structure of the present invention.
Figure 4B:
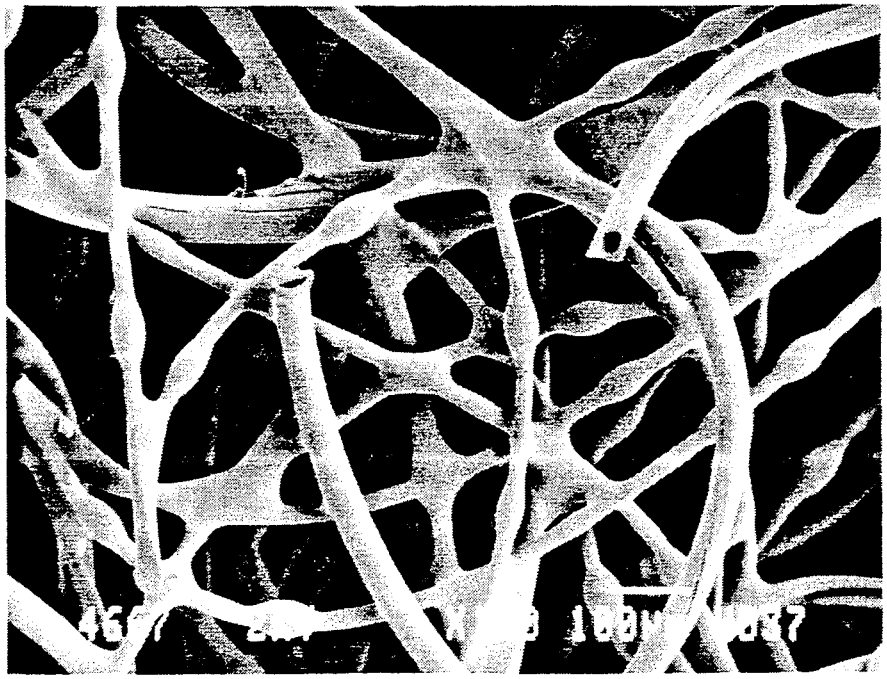
Figure 5A:
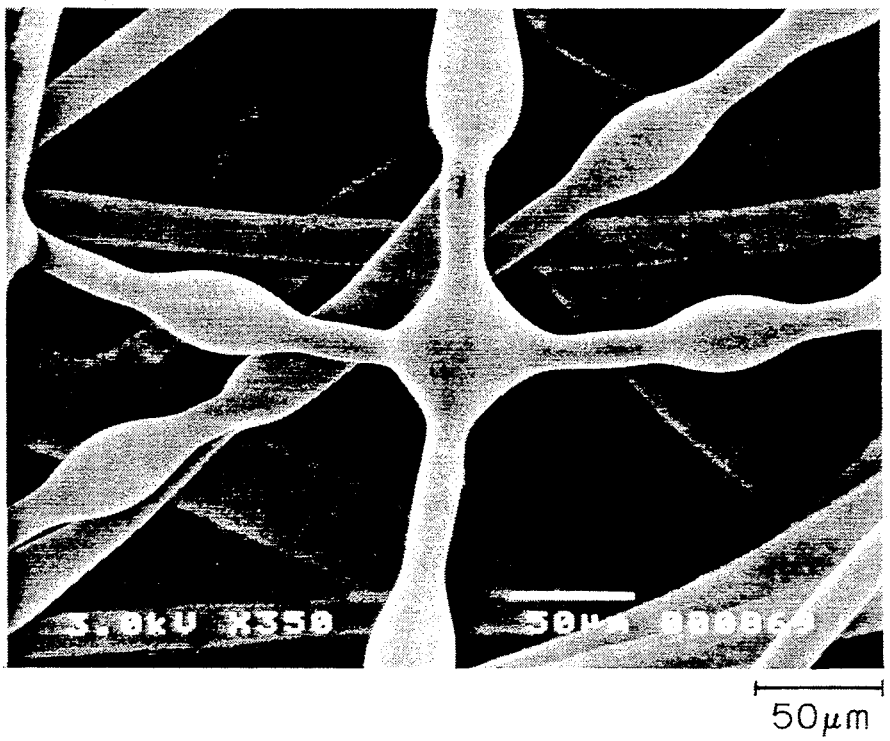
FIGS. 5(*a*), (*b*) and (*c*) are electron micrographs of the flexible heat-bonded spots scatteringly present in the cushion structure of the present invention (magnification: 350X).
Figure 5B:
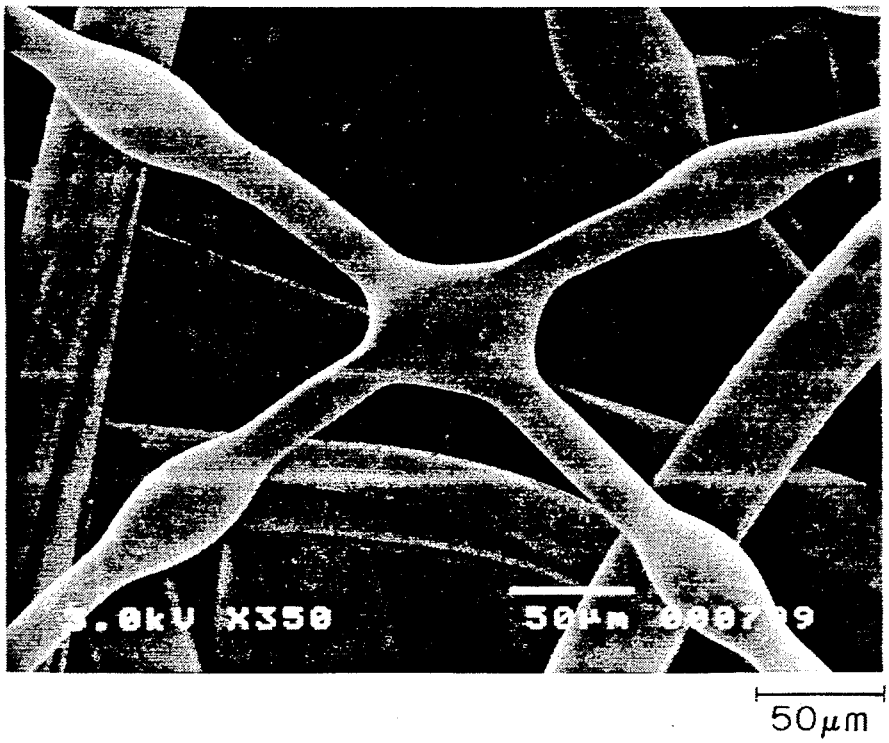
Figure 5C:
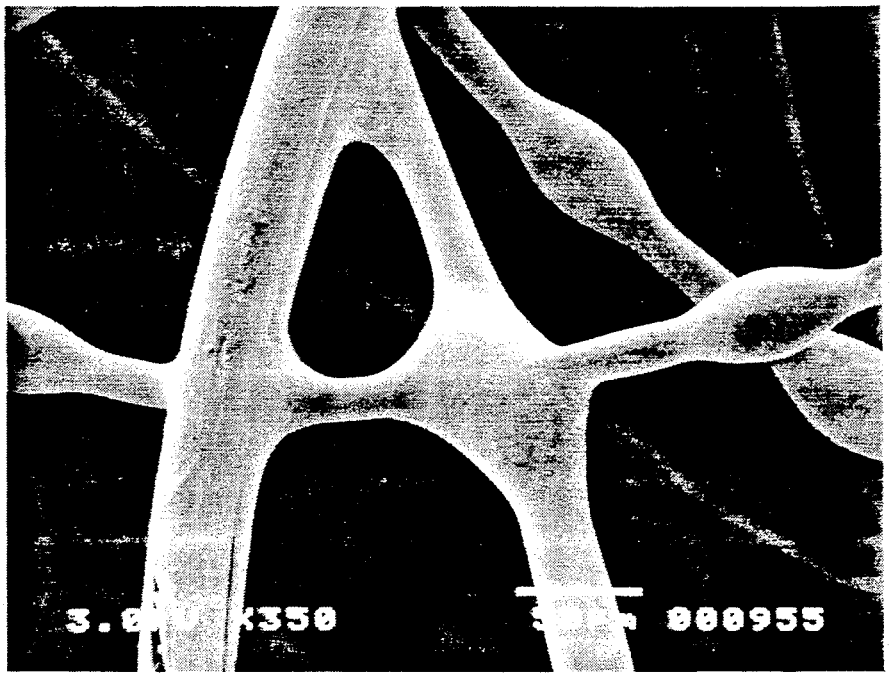

When this cushion structure was minutely observed with an electron microscope, it was found to have the structure as illustrated in FIGS. 4 and 5. Thus, it was observed that crossing points among the elastomeric conjugated fibers were integrated by fusion of the thermoplastic elastomer and amebic heat-bonded spots were scatteringly formed (FIGS. 1 and 2); and that crossing points between the non-elastomeric, crimped polyester staple fibers and the elastomeric conjugated fibers were similarly integrated by fusion of the thermoplastic elastomer and the heat-bonded spots [FIG. 1, FIG. 2(*c*)] were scatteringly formed in the structure. The W/D (n=10) of those heat-bonded spots (A) was 3.20. The heat-bonded spots inclusive of (A) and (B) had a breaking strength of 1 g/de, an elongation at break of 62%, and the elastic recovery percentage of 10% elongation of 92%. The density of the cushion structure was as low as 0.035 g/cm$^3$, and a considerable number of the spots at which the elastomeric conjugated fibers were three-dimensionally and intimately bound by mutual fusion were observed. Furthermore, a large number of thick portions 3 as illustrated in FIGS. 1 and 2 also were observed.

In consequence, the cushion structure exhibited excellent air-permeability. This cushion structure did not exhibit such initial hardness under compression that is observed in foamed polyurethane mat, but had excellent cushioning property. The structure also exhibited high compression resilience of 4 kg and high compression durability of 60%, and its recovery from compression has been improved to as much as 72%. Thus an indeed ideal cushion structure was provided.

REFERENTIAL EXAMPLE

A copolyester was prepared from an acid component which was a 60/40 (mole %) mixture of terephthalic acid and isophthalic acid, and a diol component which was a 85/15 (mole %) mixture of ethylene glycol and diethylene glycol. The polymer had an inherent viscosity of 0.8. Although the melting point of this polymer was not distinct, it softened and started to flow in the vicinity of 100° C. Thus, 110° C. was deemed to be the softening point of this polymer. A film of this polymer exhibited almost equivalent strength to that of the film in Example 1, but its elongation-at-break was as low as 5%, that is, it was a hard polymer.

A cushion structure was prepared through identical procedures with those employed in Example 1, except that the above polymer was used as the sheath component of the conjugated fiber and the heat-treating temperature was changed to 150° C. An electron microscopic observation of the binding condition in the resultant cushion structure found no amebic heat-bonded spot resembling those in the present invention or the thick portion. Incidentally, the W/D of the heat-bonded spots (A) was 1.8. The heat-bonded spots inclusive of (A) and (B) had a breaking strength of 0.3 g/de, and an elongation at break of 4%. Consequently, the elastic recovery percentage of 10% elongation of those heat-bonded spots could not be measured.

This cushion structure exhibited poor cushioning property. Although the initial compression resilience was as high as 6 kg, but the resilient property markedly deteriorated under the second and subsequent compressions. In fact, measurement for the compression durability and recovery from compression showed 20% and 50%, respectively, and thus, it was a cushion structure seriously defective in durability.

COMPARATIVE EXAMPLES 1 and 2

A structure obtained in identical manner with Example 1, except that the webs were packed in the mold to a density of 0.12 g/cm$^3$ and heat-treated, showed an extremely high density which corresponds to that of a loose structured paper. Accordingly, the elastomeric conjugated fibers could not form three-dimensional bondages among themselves in the internal structure and were mutually fused in substantially parallel state and densified. And, because the surfaces began to densify, the structure was very heavy in feeling and hard when compressed, and had an appearance resembling a mass of resin. Hence, it was entirely unfit as a cushion structure.

Also when the webs were packed in the mold to a web density of 0.004 g/cm$^3$ and heat-treated, the product had an extremely little resilience and a non-uniform construction. The resultant structure had an extremely low compression resilience of 0.2 kg.

COMPARATIVE EXAMPLES 3 and 4

When Example 1 was repeated except the heat-treating temperature was changed to 160° C., the thermoplastic elastomer failed to gather to the crossing points of the non-elastomeric, crimped polyester staple fibers in the resultant cushion structure. Consequently the crossing points were barely bonded by the heat fusion, failing to assume the amebic configuration. The heat-bonded spots had a strength of 0.1 g/de and were ready to separate. The compression resilience of the cushion structure also was as low as 34%. Again, when the heat-treating temperature was raised to 238° C., the thermoplastic elastomer yellowed and lost elasticity. The cushion structure showed no resilience to compression. Its compression durability and recovery from compression were low, such as 38% and 55%, respectively.

EXAMPLE 2

A dehydrated polymethylene glycol having a hydroxyl value of 102 and 1,4-bis(hydroxyethoxy)benzene were mixed and dissolved, while stirring, in a kneader equipped with a jacket. To the mixture solution p,p'-diphenylmethane diisocyanate was added at 85° C. and allowed to react, to provide a powdery thermoplastic polyurethane elastomer (softening point: 151° C.), which was pelletized with an extruder. This thermoplastic polyurethane elastomer was used as a sheath and polybutylene terephthalate, as a core, to prepare an elastomeric conjugated fiber (weight ratio: 50/50). A cushion structure was obtained in approximately the same manner as in Example 1.

In the resultant cushion structure, morphologically, crossing points between two conjugated fibers and also those between the non-elastomeric, crimped polyester staple fibers and the conjugated fibers were integrated by fused polyurethane elastomer. The structure had a density of 0.035 g/cm$^3$ and exhibited high air-permeability. The heat-bonded spots (A) had a W/D of 2.8. The heat-bonded spots inclusive of both (A) and (B) had the breaking strength of 0.6 g/de and the elongation at break of 15%, and the elastic recovery from 10% elongation was as high as 95%.

This cushion structure was soft under compression and readily compressible. Its resilience to compression was 2 kg, which was somewhat low. On the other hand, the compression durability and recovery from compression were as high as 49% and 65%, respectively. The product was thus useful as a cushion structure.

COMPARATIVE EXAMPLE 5

The same hollow polyethylene terephthalate staple fibers as those used in Example 1, having a single fiber size of 14 deniers and fiber length of 64 mm were formed into webs with a carding machine. Separately, as a binder solution a 40% by weight trichrene solution of a urethane prepolymer (NCO 5%, synthesized from "MN 3050" and "T-80" supplied by Mitsui-Nisso Urethane K.K.), and added with 0.2% of a silicon foam regulator was used, in which the webs were immersed, then thrown into a centrifugal dryer and dried so that the webs had a urethane pick-up of 30% after drying.

Thereafter, the above binder-impregnated webs were packed into a perforated, flat sheet plate mold, and 100° C. steam was blown thereinto to harden the urethane binder, followed by drying at 120° C., and the fibrous structure was taken out.

The structure had a density of 0.035 g/cm$^3$. When it was observed through an electron microscope, crossing points among the non-elastomeric, crimped staple fibers themselves were bound with the urethane resin, but the amount of the resin adhered between bonded points was very uneven. Furthermore, the urethane resin portions were foamed, and holes were observed therein. The heat-bonded spots had a low strength of 0.2 g/de and an elongation of 14%. The elastic recovery percentage of 10% elongation of the heat-bonded spots was 78%.

This cushion structure showed a rather low compression durability of 45% and also an inferior recovery from compression of 60%. Thus, the cushion structure had a defect in durability.

POSSIBILITY OF INDUSTRIAL UTILITY

Compared to foamed urethane mats, the cushion structure of the present invention is free of the initial hardness under compression and has a high resilience which increases approximately in proportion to the amount of compression, resulting in extremely little bottom-hit feel. Because the structure itself is low in density, furthermore, it is highly air-permeable and not liable to cause stuffiness.

In respect of durability under repetitive compression, the heat-bonded spots are resistant to breakage and readily restore their original forms when deformed, exhibiting excellent compression durability.

Furthermore, in the manufacture of this structure, uniform cushion structures can be provided by a simple and short step of only subjecting staple fiber webs to dry heat-treatment. It is furthermore possible to locally change hardness or to change the hardness in the thickness direction with ease, by varying blend ratio of the fibers, fiber composition or density.

Accordingly, the cushion structure of the present invention excels in cushioning property, resilience, durability and recovery, and furthermore has the characteristic properties that it is highly air-permeable and cause little stuffiness. In the manufacture, moreover, unevenness in processing is seldom observed, versatile processing can be designed and the manufacturing steps are short. Therefore, the structure is useful as various cushioning materials, such as those for furniture, beds, beddings, various seats, etc.

We claim:

1. A cushion structure comprising an aggregate of non-elastomeric, crimped polyester staple fiber as the matrix and having a density of 0.005 to 0.10 g/cm$^3$ and a thickness of at least 5 mm, which is characterized in that the aggregate contains, as dispersed and mixed therein, an elastomeric conjugated fiber composed of a thermoplastic elastomer having a melting point lower than that of the polyester polymer constituting the staple fibers, by at least 40° C. and a non-elastomeric polyester, the former being exposed at least at the fiber surface, in which cushion structure (A) amebic, all-directionally flexible heat-bonded spots formed by mutual heat fusion of said elastomeric conjugated fibers at their crossing points, and (B) semi-all-directionally flexible heat-bonded spots formed by heat fusion of said elastomeric conjugated fibers with said non-elastomeric polyester staple fibers at their crossing points, are present scatteringly and in the elastomeric conjugated fiber present between any two adjacent, flexible heat-bonded spots, some of the conjugated fibers have at least one thick portion in the longitudinal direction.

2. A cushion structure set forth in claim 1, in which the fusion configuration of any one of the amebic, all-directionally flexible heat-bonded spots satisfies the expression of $2.0 < W/D < 4.0$, where W stands for the width of the heat-bonded spot, and D stands for the mean diameter of the fibers participating in the heat-bonded spot.

3. A cushion structure set forth in claim 1, in which the conjugated fibers present between any two adjacent, flexible heat-bonded spots form coiled, elastomeric crimps and/or elastomeric loops.

4. A cushion structure set forth in claim 1, in which the breaking strength of the flexible heat-bonded spot is between 0.3 and 0.5 g/de.

5. A cushion structure set forth in claim 1, in which the elongation at break of the flexible heat-bonded spot is 15 to 200%.

6. A cushion structure set forth in claim 1, in which the elastic recovery percentage of 10% elongation of the flexible heat-bonded spot is at least 80%.

7. A cushion structure set forth in claim 1, in which the non-elastomeric, crimped polyester staple fiber contains polyethylene terephthalate staple fiber.

8. A cushion structure set forth in claim 1, in which the non-elastomeric, crimped staple fiber has a single fiber size of 2 to 500 de.

9. A cushion structure set forth in claim 1, in which the thermoplastic elastomer in the elastomeric conjugated fiber occupies at least 60% of the fiber surface.

10. A cushion structure set forth in claim 1, in which the conjugation ratio (by weight) of the thermoplastic elastomer to the non-elastomeric polyester in the elastomeric conjugated fiber is 30/70 to 70/30.

11. A cushion structure set forth in claim 1, 9 or 10, in which the elastomeric conjugated fiber is a side-by-side type.

12. A cushion structure set forth in claim 1, 9 or 10, in which the elastomeric conjugated fiber is a sheath-core type.

13. A cushion structure set forth in claim 10, in which the thermoplastic elastomer is a block-copolymerized polyester having as the hard segment polybutylene terephthalate polyester, and as the soft segment, polyoxybutylene polyether.

14. A cushion structure set forth in claims 13, in which the inherent viscosity of the thermoplastic elastomer is 0.8 to 1.7.

15. A cushion structure set forth in claim 10, in which the non-elastomeric polyester is polybutylene terephthalate polymer.

16. A cushion structure set forth in claim 1, in which the elastomeric conjugated fiber is contained in the cushion structure in a proportion of 20 to 60% by weight.

17. A cushion structure set forth in claim 1, which has a thickness of at least 10 mm.

18. A cushion structure set forth in claim 1, which has a density of 0.01 to 0.08 g/cm$^3$.

19. A process for producing a cushion structure which comprises mixing a non-elastomeric, crimped polyester staple fiber with an elastomeric conjugated fiber composed of a thermoplastic elastomer having a melting point lower than that of the polyester polymer composing said non-elastomeric, crimped polyester staple fiber, by at least 40° C., the former occupying at least ½ of the fiber surface, to form a web having a bulkiness of at least 30 cm$^3$/g, whereby forming three-dimensional fiber crossing points among the conjugated fibers or between the non-elastomeric, crimped polyester staple fibers and the conjugated fibers; and thereafter heat-treating the web at a temperature which is lower than the melting point of the polyester polymer but higher than that of the elastomer by 10°–80° C., to cause heat-fusion of at least a part of these fiber-crossing points.

20. A process for producing a cushion structure set forth in claim 19, in which the non-elastomeric, crimped polyester staple fiber contains crimped polyethylene terephthalate staple fiber.

21. A process for producing a cushion structure set forth in claim 19 or 20, in which the single fiber size of the non-elastomeric, crimped polyester staple fiber is 2 to 500 de.

22. A process for producing a cushion structure set forth in claim 19, in which the thermoplastic elastomer has an elongation at break of at least 500%, a 300% elongation stress of not more than 0.8 km/mm$^2$ and an elastic recovery percentage of 300% elongation of at least 60%.

23. A process for producing a cushion structure set forth in claim 19, in which the thermoplastic elastomer is a block copolymerized polyester having as the hard segment polybutylene terephthalate polyester and as the soft segment, polyoxybutylene polyether.

24. A process for producing a cushion structure set forth in claim 23, in which the thermoplastic elastomer has an inherent viscosity of 0.8 to 1.7.

25. A process for producing a cushion structure set forth in claim 19, in which a conjugated fiber, at least ½ of whose surface is occupied by the thermoplastic elastomer, is dispersed and mixed.

26. A process for producing a cushion structure set forth in claim 19, in which the non-elastomeric polyester is polybutylene terephthalate polymer.

27. A process for producing a cushion structure set forth in claim 19, in which the elastomeric conjugated fiber is a side-by-side type.

28. A process for producing a cushion structure set forth in claim 19, in which the elastomeric conjugated fiber is a sheath-core type.

29. A process for producing a cushion structure set forth in claim 19, which uses the conjugated fiber wherein the conjugation ratio (by weight) of the thermoplastic elastomer to the non-elastomeric polyester is 30/70 to 70/30.

30. A process for producing a cushion structure set forth in claim 19, in which the ratio of the elastomeric conjugated fiber in the web after the mixing is 2 to 60% by weight.

* * * * *